US005983521A

United States Patent [19]

Thompson

[11] Patent Number: 5,983,521

[45] Date of Patent: Nov. 16, 1999

[54] PROCESS FOR SPLITTING RECYCLED COMBUSTION GASES IN A DRYING SYSTEM

[75] Inventor: Stanley P. Thompson, Topeka, Kans.

[73] Assignee: Beloit Technologies, Inc., Wilmington, Del.

[21] Appl. No.: 08/949,134

[22] Filed: Oct. 10, 1997

[51] Int. Cl.[6] ..... F26B 7/00

[52] U.S. Cl. ..... 34/379; 34/423; 34/467; 34/477; 34/487; 34/514; 432/72; 110/216

[58] Field of Search ..... 34/377, 378, 379, 34/467, 476, 477, 479, 487, 488, 423, 514, 79; 110/216, 245; 432/72, 59

[56] References Cited

U.S. PATENT DOCUMENTS

| | | | |
|---|---|---|---|
| 3,861,055 | 1/1975 | Thompson | 34/363 |
| 4,445,976 | 5/1984 | LaDelfa et al. | 201/41 |
| 4,780,965 | 11/1988 | Grafen et al. | 34/478 |
| 4,888,884 | 12/1989 | Bartling et al. | 34/479 |
| 4,989,344 | 2/1991 | Glorioso | 34/378 |
| 5,295,310 | 3/1994 | Eriksson | 34/480 |
| 5,588,222 | 12/1996 | Thompson | 34/379 |
| 5,675,912 | 10/1997 | Thompson | 34/494 |

*Primary Examiner*—Henry Bennett
*Assistant Examiner*—Pamela A. Wilson
*Attorney, Agent, or Firm*—Shook, Hardy & Bacon L.L.P.

[57] ABSTRACT

A process for drying a wet material in a drying system includes supplying a current of heated gas to a dryer from a combustion chamber. The material is exposed to the current in the dryer. The dried material is separated from the current of heated gas. The current of heated gas is split into a first stream of heated gas and a second stream of heated gas after the dried material has been separated. The first stream of heated gas is introduced into the combustion chamber so that the first stream is further oxidized therein. A third stream of heated gas is removed from the combustion chamber. The third stream includes at least a portion of the first stream. The second stream of heated gas is introduced into the combustion chamber so that it makes up a portion of the current conveyed to the dryer.

6 Claims, 1 Drawing Sheet

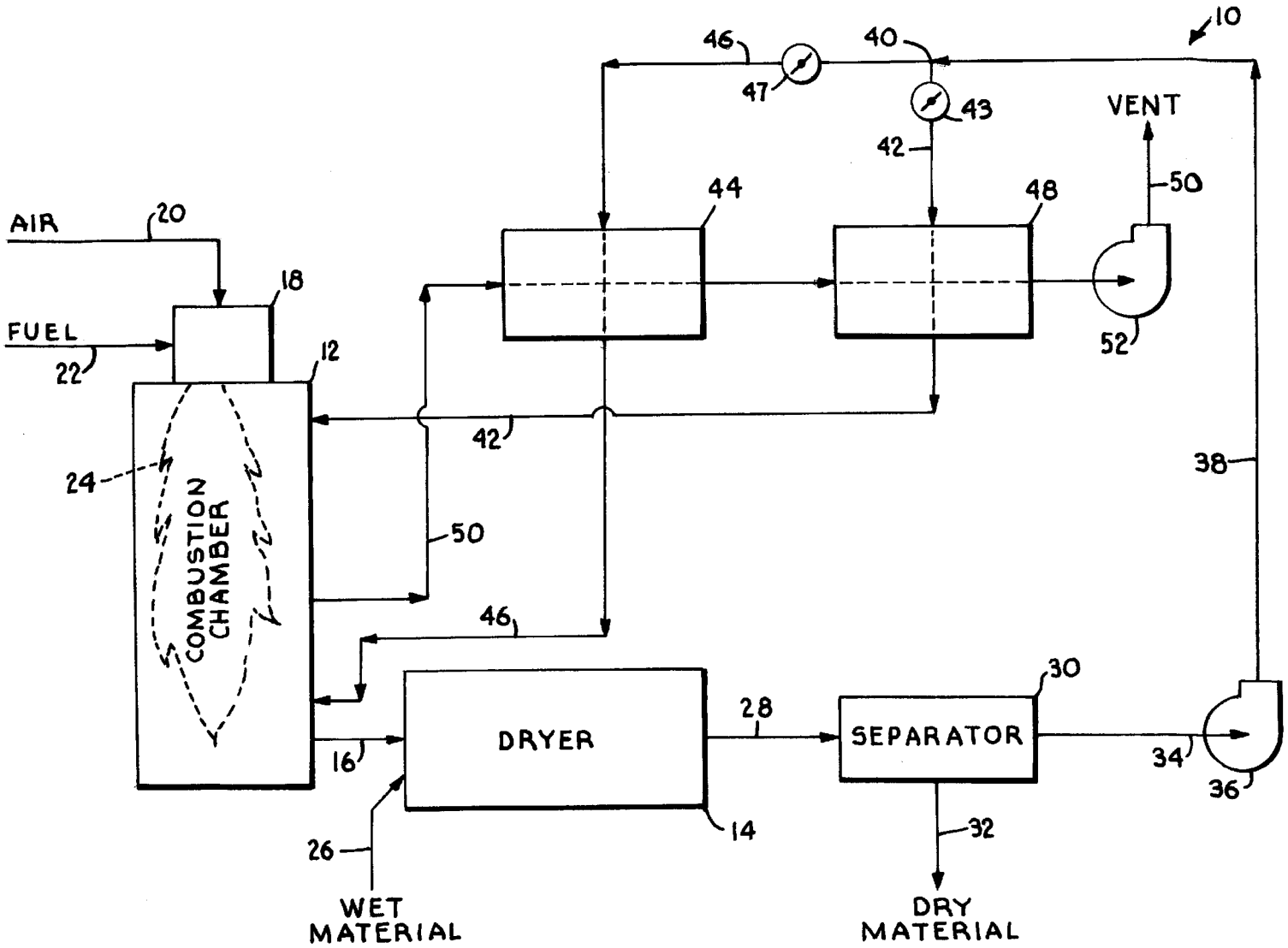
10
VENT
50
52
38
36
34
48
43
40
42
30
SEPARATOR
32
DRY MATERIAL
47
46
44
28
14
DRYER
42
50
46
WET MATERIAL
16
26
12
18
COMBUSTION CHAMBER
20
AIR
FUEL
22
24

PROCESS FOR SPLITTING RECYCLED COMBUSTION GASES IN A DRYING SYSTEM

BACKGROUND OF INVENTION

This invention relates to a process for use in a drying system where combustion gases are recycled through the drying system to oxidize pollutants prior to the combustion gases being vented to the atmosphere.

Drying systems are important features in the manufacture and processing of many different materials. For example, drying systems are often used to dry wood chips during the manufacture of particle board. Further, drying systems are used during the processing of ethanol. More particularly, after ethanol has been removed from grain during a fermentation process, it is then desirable to dry the grain to allow storage and resale of the grain for animal feed or other uses.

Typical drying systems include a combustion chamber into which natural gas and air are supplied and combusted. The heated combustion gases in the combustion chamber are then induced by a draft fan into a rotating cylindrical dryer. The material to be dried is introduced into the dryer and exposed to the current of heated gases. The dried material is then separated from the heated gas current in a cyclone separator. The remaining heated gases are then vented to the environment. An example of the typical drying system of the prior art is disclosed in U.S. Pat. No. 3,861,055, which is incorporated herein by reference.

Numerous problems and disadvantages are associated with these prior art drying systems. A major problem involves the venting of the combustion gases to the atmosphere. More particularly, these combustion gases contain various pollutants. For example, the gases oftentimes contain volatile organic compounds (VOC's), carbon dioxide ($CO_2$), and nitric oxide (NO). In addition to pollutants that result from the combustion process in the combustion chamber, pollutants can also result from the drying of the material itself. For instance, in the drying of wood chips or other organic material, particulate and VOC's are often contained in the combustion gases as they are vented to the atmosphere. Because governmental standards set the level of pollutants that can be vented to the atmosphere, it is often necessary to add additional pollution control devices to the drying systems to reduce the pollutant levels in the gas stream prior to venting. These devices often are add-on oxidizers which oxidize the VOC's and particulate present in the gas stream to reduce such pollutants to an acceptable level. These pollution control devices are typically expensive to install and operate.

Another disadvantage associated with prior art drying systems and processes involves the fire hazard associated with excessive amounts of oxygen ($O_2$) in the combustion gases. More particularly to convey the material to be dried to the dryer, a large volume of moving gas is needed. This is especially true when the material contains a large percentage of moisture. Typically, drying systems make up the necessary volume by introducing excess air during the combustion process in the combustion chamber. Although this results in a suitable volume of gas to convey the materials, it also results in an excessive amount of $O_2$ in the combustion gases. In many instances, the amount of $O_2$ exceeds the allowable fire and explosion standards. The use of large amounts of excess air also results in other problems with these drying systems. More particularly, increasing the excess air admitted in the combustion chamber results in a decrease in the temperature of the combustion gases exiting the burner.

In order to reduce the amount of $O_2$ in the combustion gases and increase the temperature levels of combustion gases to a suitable level for drying, attempts have been made to decrease the amount of excess air introduced into the combustion chamber. However, reducing the amount of excess air results in various other inherent disadvantages with the dryer system. More particularly, as is apparent, decreasing excess air results in a lower volume gas flowing through the drying chamber. This can result in ineffective and/or unstable pneumatic conveying of the product through the drying system.

Some prior art drying systems have attempted to address the above-discussed problems. More specifically, in one type of drying system, all of the combustion gases exiting the dryer are recycled back into a combustion chamber for oxidation. Gases are also taken out of the drying system at the combustion chamber and vented to the atmosphere. Recycled gases flowing into the combustion chamber and those flowing out of the combustion chamber are run through a heat exchanger wherein the heat from the gases flowing out of the combustion chamber and to the atmosphere is transferred to the recycled gases flowing into the combustion chamber. This type of drying system suffers from various disadvantages. First, because the entire quantity of combustion gases is recycled to the combustion chamber for oxidation, this drying system operates within very narrow operating parameters. More specifically, the prior art system only operates in an optimal manner at a particular capacity of the drying system. If the capacity of the drying system varies from the particular level, the oxidation temperature of the recycled gases and the inlet temperatures of the gases to the dryer could vary substantially. Because these factors could vary over large ranges, differing levels of pollutants were vented to the atmosphere depending on the capacity at which the prior art system was run. Further, again depending on the capacity, the dryer inlet temperature could vary substantially, thus resulting in inconsistent or incomplete drying of the material.

Therefore, a drying system is needed that oxidizes pollutants within the system so that external pollution control devices are not needed. Further, a drying system process is needed which decreases the amount of $O_2$ present in the system to a level below fire standards without affecting the efficiency of the dryer due to the lack of available conveying gases. Still furthermore, a drying process is needed which will keep the oxidation temperature and dryer system efficiency all substantially constant throughout a large variance in the capacity of the drying system.

SUMMARY OF INVENTION

One object of the present invention is to reduce the emission of pollutants from a drying process into the atmosphere.

Another object of the present invention is to internally reduce the pollutant emission level of the drying process to a level that is below set governmental standards. This reduction of emissions eliminates the need for using expensive emission control devices in conjunction with the drying system.

Another object of the present invention is to reduce the amount of oxygen in the drying system so that a wider margin of safety exists to reduce potential fire and explosion hazards.

A further object of the present invention is to maintain a substantially constant oxidation temperature throughout a wide range of different capacity situations for a dryer system.

Another object of the present invention is to maintain a substantially constant dryer system efficiency throughout a wide range of dryer system capacity situations.

Additional objects, advantages, and novel features of the invention will be set forth in part in the description which follows and in part will become apparent to those skilled in the art upon examination of the following, or maybe learned by practicing the invention. The objects and advantages of the invention may be realized and obtained by means of the instrumentalities in combinations particularly pointed out in the appended claims.

BRIEF DESCRIPTION OF THE DRAWING

In the accompanying drawing which forms a part of the specification and is read in conjunction herewith, the drawing is a diagrammatic view of a drying system utilizing the process of the present invention.

DETAILED DESCRIPTION OF THE PREFERRED EMBODIMENT

With reference to the FIGURE, a drying system 10 utilizing the process of the present invention is shown diagrammatically. A vertically oriented combustion chamber 12 supplies a current of heated gas to a dryer 14, as indicated by the reference numeral 16. Chamber 12 has a burner 18 disposed on its upper end. Air and a fuel, such as natural gas, are supplied to burner 18 as indicated by reference numerals 20 and 22, respectively. Burner 18 ignites the air and natural gas to form a downwardly extending burner flame 24.

Wet material to be dried is introduced into dryer 14 as indicated by the reference numeral 26. In dryer 14 the wet material is exposed to the heated gas current so that the moisture content of the material is reduced. The current of heated gas flowing through dryer 14 serves to convey the wet material therethrough.

After the moisture content of the material has been reduced in dryer 14, the material and the current of heated gas are conveyed, as indicated by the reference numeral 28, to a separator 30. In separator 30, the partially dried material is separated from the heated gas. The dried material exits separator 30 as indicated by the reference numeral 32. The heated gas current also exits separator 30 as is indicated by the reference numeral 34. The current is then conveyed to a fan 36. The current exits from fan 36 as indicated by the reference numeral 38. The current of heated gas exiting fan 38 is then split at point 40 into two separate streams. One stream 42 is conveyed back to the upper portion of combustion chamber 12. A damper 43 is positioned in stream 42 to control the amount of heated gas conveyed to the upper portion of chamber 12. Before being introduced into combustion chamber 12, stream 42 is conveyed through a heat exchanger 48. The purpose of heat exchanger 48 will be more fully described below. Stream 42 is introduced into chamber 12 such that it swirls around burner flame 24 to oxidize the pollutants remaining in stream 42. The gases introduced by stream 42 flow downwardly around burner flame 24.

The other stream formed by the splitting of the current of heated gas at point 40 is indicated by the reference numeral 46. Stream 46 is introduced generally into the bottom portion of combustion chamber 12. A damper 47 is positioned in stream 46 to control the output of heated gas conveyed to the bottom portion or chamber 12. Prior to being introduced into chamber 12, stream 46 passes through a heat exchanger 44. The purpose of heat exchanger 44 will be more fully described below. Stream 46 is introduced into the lower end of chamber 12 such that it will form, in conjunction with the combustion gases generated by burner 18, the current 16 of heated gas.

An additional stream of heated gas exists combustion chamber 12 as indicated by the reference numeral 50. Stream 50 exits chamber 12 at a location that is between the introduction point of stream 42 and the introduction point of stream 46. Stream 50 is vented to the atmosphere via a fan 52. Prior to being vented to the atmosphere, stream 52 passes through heat exchanger 44 and heat exchanger 48.

Stream 50 generally consists of a substantial portion of stream 42. More specifically, stream 50 substantially consists of heated gases introduced into the combustion chamber by stream 42 which have been oxidized by burner flame 24 to remove pollutants. As is apparent, because stream 50 has been oxidized, it is suitable to vent stream 50 to the atmosphere.

Heat from stream 50 is transferred to stream 46 in heat exchanger 44. Further, additional heat remaining in stream 50 is transferred to stream 42 in heat exchanger 48.

In operation, drying system 10 maintains a substantially constant dryer efficiency, and a substantially constant oxidation temperature of stream 42 within chamber 12, all throughout differing capacities of wet material being dried within dryer 14. To maintain these constant parameters no matter the capacity at which the dryer system is being run, it is desirable to maintain dryer 14 at a substantially constant pressure at all times. This pressure is maintained by varying the ratio of heated gas in stream 42 to the heated gas in stream 46. More specifically, as the capacity of the wet material flowing through dryer 14 varies, the natural gas and air fed to burner 18 also varies to ensure that adequate combustion gases are generated in chamber 12 to dry the material. The pressure in dryer 14 is continuously monitored in a manner well-known in the art. Dampers 43 and 47 are adjusted to maintain a constant pressure in dryer 14 in response to the varying of capacity. Dampers 43 and 47 are controlled in a manner well-known in the art. For example, as the amount of natural gas and air is increased to burner 18, the amount of heated gases exiting via stream 50 will increase. The amount of heated gas vented to the atmosphere is directly proportional to the amount of heated gas generated in combustion chamber 12 in combination with the water vapor generated in dryer 14. As the amount of combustion gases and evaporated water increases, the pressure of dryer 14 will be sensed and dampers 43 and 47 adjusted to maintain a constant pressure. Such an adjustment will result in the amount of heated gases introduced into chamber 12 by stream 42 being increased. Thus, an increased flow of heated gases for oxidation via stream 42 also takes place when the amount of combustion gases and evaporative gases increases.

Because of this increase in stream 42, the amount of recycled gases flowing via stream 46 to the bottom of chamber 12 will decrease and damper 47 will be adjusted accordingly. More specifically, the gases introduced into the combustion chamber via stream 46 is inversely proportionate to the amount of gases generated by the combustion chamber. Therefore, as is apparent, the amount of heated gases flowing in stream 42 and stream 46 varies depending upon the output of burner 18 and dampers 43 and 47 are adjusted to ensure that dryer 14 maintains a constant pressure therein. Therefore, the ratio of the amount of gases flowing in streams 42 and stream 46 are adjusted by dampers 43 and 47 in response to varying capacities.

Heat exchangers 44 and 48 serve to transfer heat from stream 50 to streams 42 and 46. More specifically, heat exchanger 44 is a high temperature heat exchanger which serves to raise the temperature of stream 46. Heat exchanger 48 is a low temperature heat exchanger that serves to transfer some of the heat remaining in stream 50 to stream 42 to increase the oxidation efficiency.

Heat exchangers 44 and 48 serve to increase the efficiency of the overall drying system. The drying system with the split at point 40 can be utilized, however, with heat exchanger 48 alone or with heat exchanger 44 alone or without either heat exchanger 44 or 48. Further, it is contemplated that heat exchangers 44 and 48 could be of an identical construction such that they can be interchanged periodically within drying system 10 to inhibit fouling. Additionally, the heat exchangers can be capable of rotation while in place such that passages within a single heat exchanger can be exchanged. For example, exchanger 44 can be of such a construction such that the passage that normally would accommodate stream 50 will accommodate stream 46, and the passage that normally would accommodate stream 46 will accommodate stream 50. Such a construction and rotation can prevent fouling.

By setting the dryer system up as indicated above and maintaining a constant pressure within dryer 14 by varying the volume of streams 42 and 46 via dampers 43 and 47, the oxidation temperature and the efficiency of the dryer will be maintained at a substantially constant level even as the amount of material run through dryer 14 varies. More specifically, as the amount of wet material introduced into dryer 14 increases, it may be necessary to increase the output of burner 18. As stated, the pressure within dryer 14 is monitored and dampers 43 and 47 adjusted accordingly to maintain a constant pressure. As the output of burner 18 increases, so to must the amount of heated gases flowing to the atmosphere via stream 50. That is, the amount of gases generated by burner 18 plus the water vapor generated in dryer 14 must exit the system through stream 50. Therefore, for stream 50 to increase, the amount of gases to be oxidized through stream 42 must also increase and dampers 43 and 47 are adjusted accordingly. On the other hand, the output of burner 18 sometimes will be decreased due to a decrease in capacity. As this is done, the total amount of gases needed to be vented from the system via stream 50 will also decrease. Thus, the amount of gases that will need oxidation from stream 42 will also decrease. However, to ensure a constant conveyance through dryer 14, the amount of recycled gases flowing through stream 46 will increase and dampers 43 and 47 are adjusted accordingly. In this manner, by varying the amount of gas flowing through stream 42 and 46 and splitting them at point 40, the oxidation temperatures of the gases introduced by stream 42 and the overall dryer efficiency are kept at substantially constant levels. Therefore, the capacity of the wet material flowing into dryer 14 can vary greatly while maintaining constant dryer efficiency.

I claim:

1. A process for drying a wet material in a drying system, the drying system including a combustion chamber, a heat exchanger and a dryer, the process comprising:

supplying a current of heated gas to the dryer from the combustion chamber;

exposing material to be dried to said current in the dryer;

separating dried material from said current of heated gas;

splitting said current into a first stream of heated gas and a second stream of heated gas after dried material has been separated from said current;

introducing said first stream of heated gas into the combustion chamber such that said first stream is further oxidized in the combustion chamber;

removing a third stream of heated gas from the combustion chamber, said third stream including at least a portion of said first stream;

introducing said second stream of heated gas into said combustion chamber such that said second stream makes up a portion of said current; and conveying said second stream and said third stream through the heat exchanger such that heat is transferred from said third stream to said second stream.

2. The process of claim 1 wherein the drying system includes a second heat exchanger, the process further comprising:

conveying said first stream and said third stream through the second heat exchanger such that heat is transferred from said third stream to said first stream.

3. The process of claim 1 wherein the drying system includes a heat exchanger, the process further comprising:

conveying said first stream and said third stream through the heat exchanger such that heat is transferred from said third stream to said first stream.

4. The process of claim 1 wherein the combustion chamber is vertically oriented with a burner disposed adjacent an upper end of the combustion chamber so that a burner flame extends downwardly into the combustion chamber, and wherein said first stream is introduced into the combustion chamber at a first location adjacent the burner to further oxidize said first stream.

5. The process of claim 4 wherein said second stream is introduced into the combustion chamber at a second location that is below the location where said first stream is introduced.

6. The process of claim 4 wherein said third stream is removed from the combustion chamber at a third location that is between said first location and said second location.

* * * * *